US007828176B2

(12) United States Patent
Harper

(10) Patent No.: US 7,828,176 B2
(45) Date of Patent: Nov. 9, 2010

(54) FLUID DISPENSER WITH INTERNAL PUMP

(76) Inventor: William A. Harper, 16541 Redmond Way, pmb 140-C, Redmond, WA (US) 98052-4492

( * ) Notice: Subject to any disclaimer, the term of this patent is extended or adjusted under 35 U.S.C. 154(b) by 992 days.

(21) Appl. No.: 11/434,452

(22) Filed: May 15, 2006

(65) Prior Publication Data

US 2007/0262091 A1 Nov. 15, 2007

(51) Int. Cl.
*B65D 37/00* (2006.01)

(52) U.S. Cl. ..... 222/207; 222/94; 222/175; 222/209; 222/212; 222/494; 417/478; 417/479

(58) Field of Classification Search ..... 222/205, 222/207, 212, 175, 209, 94, 213–215, 105, 222/107, 450, 494; 417/478–480
See application file for complete search history.

(56) References Cited

U.S. PATENT DOCUMENTS 2,219,604 A * 10/1940 Trotter ..... 222/207
2,777,612 A 1/1957 Bensen
3,224,650 A * 12/1965 Willits, Jr. ..... 222/207
5,099,885 A 3/1992 Nilsson
5,207,355 A 5/1993 Thomsen
5,431,634 A * 7/1995 Brown ..... 604/153
6,789,706 B2 9/2004 Abergel
7,004,354 B2 2/2006 Harper
7,316,332 B2 * 1/2008 Powers et al. ..... 222/175

* cited by examiner

*Primary Examiner*—J. Casimer Jacyna

(57) ABSTRACT

A hand operated fluid dispensers comprised of a sealed flexible reservoir chamber containing a fluid, a flexible pump chamber encased by and drawing fluid from the reservoir, and a pump cycled by external pressure applied through a reservoir wall. This class of simple, inexpensive, disposable dispensers is particularly useful in packaging cosmetics, foodstuffs, and healthcare products. As pocketable dispensers they are popular for dispensing small amounts of stored viscous liquids easily damaged when exposure to the atmosphere, a condition where sealed reservoirs coupled with airless pumps working together successfully prevent such product contamination and deterioration. A method of improved healthcare employing such pump dispensers containing a hand sanitizing fluid is also discussed.

20 Claims, 2 Drawing Sheets

FLUID DISPENSER WITH INTERNAL PUMP

FIELD OF THE INVENTION

The present invention relates to hand operated fluid dispensers comprised of a sealed flexible reservoir chamber containing a fluid, a flexible pump chamber encased by and drawing fluid from the reservoir, and a pump cycled by external pressure applied through a reservoir wall. This class of simple, disposable dispensers is particularly useful in packaging cosmetics, foodstuffs, and healthcare products. As pocketable dispensers they are popular for dispensing small amounts of stored viscous liquids easily damaged when exposure to the atmosphere, a condition where sealed reservoirs coupled with airless pumps working together successfully prevent such product contamination and deterioration.

BACKGROUND OF THE INVENTION

Dispersement of relatively viscous liquids such as liquid soaps, hand sanitizing fluids, cosmetic creams, insect repellant lotions and similar fluids is often by either squeezable plastic tubes with closable caps or plastic bottles with reciprocating valve push pumps mounted on top. Conventional dispensers of these types dominate the marketplace for dispersing viscous fluids, even for smaller or pocketable containers. Yet these containers are well known for wasting irrevocable product, inconvenient handling, unfortunate leaks, product contamination and product loss through evaporation.

The packaging art has long offered solution to some of these shortcomings. For example, Bensen U.S. Pat. No. 2,777,612 (1957) disclosed a tube dispenser with a collapsible inner product pouch associated with a pneumatic pump system to dispense most of the viscous liquid product while protecting it from atmospheric contamination. Two examples of external pumps using a reciprocating chamber are Nilsson U.S. Pat. No. 5,099,885 (1992) and Thomsen U.S. Pat. No. 5,207,355 (1993). Nilsson disclosed a dispensing pump with an elastic pump chamber, deformable under direct pressure, and the subsequent hydraulic pressure closing an inlet valve and opening an outlet valve. Thomsen discloses an exterior dispensing button pump that relies on a precursor mechanical closing of the inlet passage from the reservoir, permitting subsequent pressure build in pump chamber, and fluid dispensing from the exit valve. An internal pump design is disclosed by Abergel U.S. Pat. No. 6,789,706 (2004). Abergel describes a pump chamber enclosed by a reservoir wall that communicates pressure to the pump building fluid pressure that activates both outlet and inlet valves for discharging and refill. A simple, low-cost pump design is described by Harper U.S. Pat. No. 7,004,354 (2006). Harper discloses a reservoir chamber and dispersement chamber separated by a self-forming choke valve that prevents fluid passage unless purposefully distorted so that pump pressure can build sufficient to exit the outlet passage for dispersement; there is no auto refill feature and the system uses a stripping action more than actual pumping of fluid for dispersement. None of the disclosures describe nor suggest a particularly low-cost, minimal part pump action that is easy to manufacture and operate. The need for a fluid dispenser that employs an internal pump, in a thin compact package of minimal construct has yet to be designed.

SUMMARY OF THE INVENTION

The present invention recognizes the abundance of the prior art and contributes a specific advancement over that same art. Accordingly it is a particular intent of the present invention to provide a simple internal pump within a pouch reservoir forming a liquid dispenser of such a size and shape as to be carried in a pocket or hung about a neck and thus promotes convenient access to and timely use of the liquid product held within. Specifically, the pump located inside the liquid reservoir does not employ a one-way inlet valve for controlling liquid entering the pump chamber from the reservoir chamber as disclosed by the prior art. Instead, the common wall between the chambers has a simple aperture, a hole, which is blocked only when external pressure is applied by a finger to the outer reservoir wall which is pushed against the aperture, blocking the now pressurized pump fluid from transferring back to the reservoir chamber. The pressure of the pump fluid grows as the pump chamber is squeezed by an externally hand, when sufficient pressure is obtained the fluid opens the one-way exit valve and is dispersed until the pump chamber is emptied and the fluidic pressure therein drops. Upon removal of the finger and its induced pressure the elastic nature of the pump reforms its original volume and shape, drawing in a new dose of reservoir fluid through the now unblocked aperture in the common wall between chambers, this being the only recharge route available in that the exit valve has returned to it original closed state without pressurized fluid to keep it open. The aperture becomes unblocked absent the external pressure holding the reservoir wall against the aperture and the external wall has separated from the interior common wall and both reformed to their mutually apart relationship.

This simple pump, essentially a combination of two film walls, an exit valve, and a hole, requires a minimal number of components and materials. Yet, surprisingly, this design has proven to be very effective, durable, and highly reliable. Because the pump is easily squeezed by a variety of hand and finger configurations it has proven particularly useful to persons with limited hand mobility where a stripping action to discharge the fluid is problematic. Also, by placing the pump within the reservoir an overall flat, even stylish package is formed which significantly facilitates convenient access and timely usage. Finally, the simplicity of the overall design of the pump, reservoir, aperture and one valve, all of which can be constructed of various flexible polymer films of differing elastic properties, is of such a nature as to simply and reliable manufacture at an extremely low-cost while making use of a minimal amount of materials.

It is therefore the principal objective of this invention to provide a finger operated fluid pump dispenser offering the utmost simplicity and economy while also proving high reliable and convenience of use.

A specific object of this invention is to provide a fluid dispenser which is of such few parts and simple design as to be readily adaptable to a straightforward and economical manufacturing process.

Another object of the present invention is to create a fluid dispenser of such minimal weight, size and design that it promotes widespread and convenient product usage while conserving packaging material.

Another object of the present invention is to provide a fluid dispenser designed to disperse all fluid held so as to avoid irretrievable product wastage.

Another object of the present invention is to provide a fluid dispenser capable of easily dispensing multiple measured dose of dispersed fluid product.

Another object of the present invention is to provide a fluid dispenser sealed against both atmospheric contamination from without and loss of fluidic quality and/or quantity from within.

Another object of the present invention is to offer a fluid dispenser capable of being operated by persons with limited hand strength, size and dexterity.

Another object of the present invention is to provide a fluid dispenser that incorporates attachment mechanisms which promote convenient and timely access to the dispensed fluid product.

A final and substantive object of the present invention is to provide a fluid dispenser capable by its design, content and distribution of achieving a heightened degree of health and wellbeing among a population.

These and other objects and advantages of the present invention will become apparent from the following description taken in conjunction where appropriate with the accompanying drawings wherein are set forth, by way of illustrations and example, certain embodiments of this invention. The drawings constitute a part of this specification and include exemplary embodiments of the present invention and illustrate various objects and features thereof.

BRIEF DESCRIPTION OF THE DRAWINGS

The invention will be better understood and objects other than those set forth above will become apparent when consideration is given to the following detailed description thereof. Reference is made in the following briefly described drawings, wherein like reference numbers refer to corresponding elements.

DETAILED DESCRIPTION OF THE INVENTION

While the invention will be described in connection with illustrations, descriptions, and examples of preferred embodiments, it will be understood these are not intended to limit the present invention only to these embodiments. On the contrary, the present invention is to cover all structural and/or functional alternatives as generally described. Following are three embodiments of the present invention which demonstrates both representative forms and applications of the present invention.

Example 1

Figure 1:
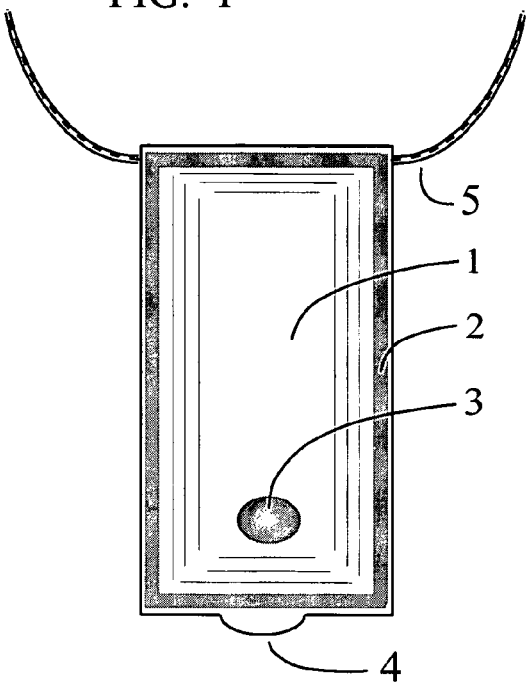
FIG. 1 is a frontal view of a sealed fluid dispenser with an internal pump, lanyard attachment, and surface indices indicating placement of pump pressure.
Figure 2:
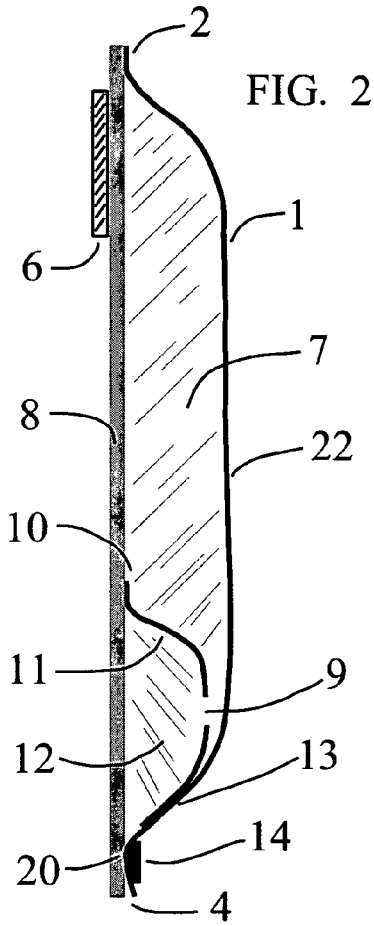
FIG. 2 is a side view after the previous figure showing a flexible reservoir front wall, a stiff back wall, a resilient internal pump wall, aperture, and exit valve.

In FIG. 1 a frontal view of a rectangular shaped fluid dispenser 1 is illustrated. At the top is an attached lanyard 5 used to hang the dispenser 1 from a user's neck or other objects. On all sides are border seals 2 joining the front and rear walls forming the dispenser 1. At the bottom of the figure is an exit orifice 4 where the contained fluid product within is dispersed. On the surface of the dispenser 1 is a cuing means, a visual and/or tactile mark 3 indicating where hand, thumb, palm and/or finger pressure is to be applied to create sufficient internal pump pressure for fluid dispersement. When tactile in nature, such as a raised ridge on the surface, this mark 3 obviates the need for the user to look at the dispenser in order to determine where to apply pressure to an obscured pump located within the dispenser 1. FIG. 2 shows a cross sectional view of the fluid dispenser 1 wherein the reservoir chamber 7 is defined by the flexible front wall 22 joined by border seals to a stiff back wall 8. An alternative attachment means, here an adhesive strip 6, is shown affixed to the back wall 8 for attaching the dispenser 1 to another object such as an identification badge worn by a user. Other attachment means found useful are buckles, buttons, clasps, fasteners, holes, loops, magnets, pins, rivets, screws, ties, twists, and Velcro. Liquid product to be dispersed is stored in the reservoir chamber 7 and is drawn in to the pump chamber 12 for dispersement.

FIG. 2 also shows a pump chamber 12 with a resilient common wall 11 that separates the reservoir 7 and the pump 12 chambers so that the reservoir chamber partially enclosed the pump chamber 12. The only channel of fluidic communication between the chambers 7, 12 is through an aperture 9 in the common wall 11 which is sealed to the reservoir walls 8, 22 at various points 10, 13. There is a dispensing channel 20 connecting the pump reservoir 12 with exit orifice 4. Controlling fluidic passage in this dispensing channel 20 is a one-way valve which permits only exiting fluid passing under pressure. Illustrated is a simple compression valve 14 holding the channel 20 closed by tension created by a layer of elastic material which can be forced opened with sufficient fluidic pressure developed from within the pump chamber 12 by application of external pressure. Other types of exit valves 14 found useful are duckbills, checks, elastics, flaps, reeds, slits, and springs.

Figure 3:
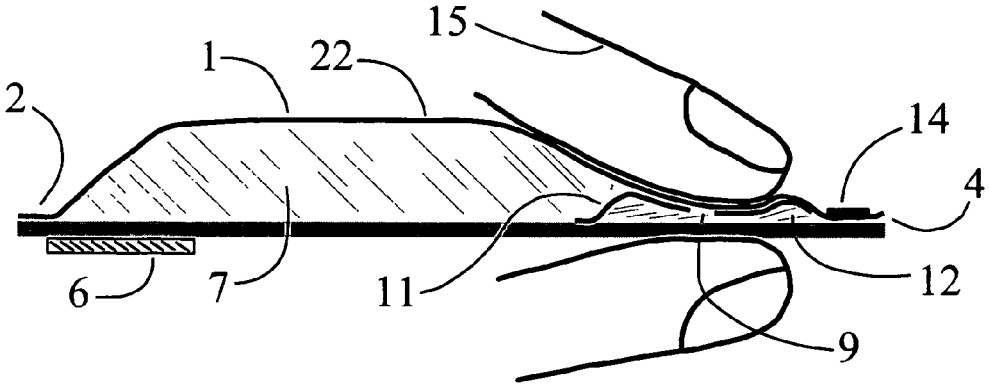
FIG. 3 is a side view of the previous figure showing fingers applying pressure to the pump through the reservoir wall and compressing the pump chamber to disperse the fluid product therein.

FIG. 3 shows the application of such external pressure to the pump chamber 12 by fingers squeezing the chamber 12 sufficient to reduce the chamber's fluidic volume and pressurized the fluid product within. Simultaneously with the fingers 15 starting to squeeze one finger's placement on the mark 3 has positioned it so as to force a portion of the reservoir's flexible wall 22 into a blocking relationship with the aperture 9 in the common wall 11 forming part of the pump chamber 12. Blocking this aperture 9 by external pressure applied to the reservoir wall 22 prevents pump chamber 12 fluid from returning to the reservoir chamber 7. With continued and increasing external pressure, and the continued blockage of the aperture 9, fluidic pressure builds in the pump chamber. The fluidic pressure builds in the pump chamber 12 and exit channel 20 to a point sufficient to open the dispensing valve 14 and disperse the pressurized fluid from the exit orifice 4. The fluid dispersement reduces the fluidic pressure below a point where the dispensing valve 14 returns to its normal closed state. Removing the fingers 15 relieves the external pressure being applied to the pump chamber 12 and without the same external pressure to hold the reservoir wall 22 in a blocking relationship with the aperture 9, the aperture 9 opens to permit fluidic communication between the reservoir 7 and pump 12 chambers. In the embodiment represented in FIG. 2 and FIG. 3 the common wall 11 is resilient, typically a polymeric film with stiff properties and/or structure which permit it to regain its original shape after momentary contortion. In this example the wall's resilient nature, returning to its normal condition, struggles to restore the pump chamber 12 to its original fluidic volume. In this process reservoir chamber 7 fluid is drawn in through the unblocked aperture 9. No fluid or air is drawn in through the exit channel 20 due to the closed dispensing valve 14. Reservoir fluid is drawn into the pump chamber 12 until the original fluidic volume of the chamber 12 has been restored. The pump is now recharged with a new measured dose of liquid product and prepared to repeat another cycle of dispersement. By employing a fully sealed disperser and one-way dispensing valve 14 the entire amount of liquid product is at all times protected from atmospheric contamination and/or loss of fluidic quality and/or quantity.

Example 2

Figure 4:
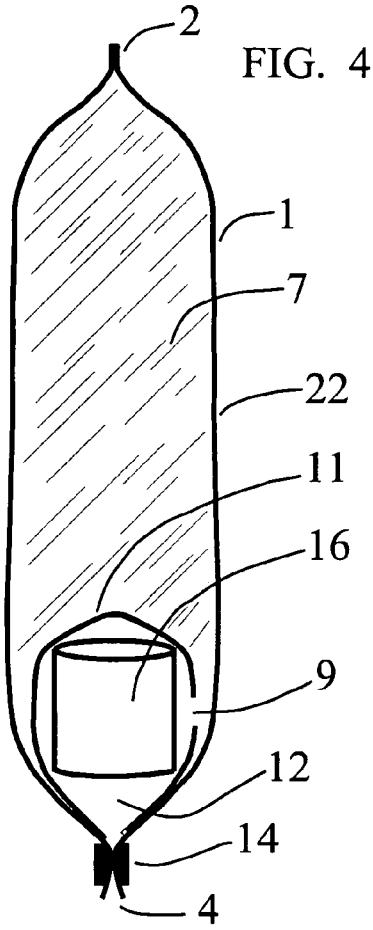
FIG. 4 is a side view of a fluid dispenser showing a sealed flexible walled reservoir, an internal pump, aperture, and an enclosed resilient pump element to restore pump chamber volume.

In FIG. 4 a side view of a fluid dispenser 1 with flexible side walls 22 is illustrated. The front and back walls 22 have boundary seals 2 in the manner of FIG. 1 and define a reservoir chamber 7 containing a liquid product as described in FIG. 2 and FIG. 3. A pump chamber 11 is fully enclosed by the reservoir chamber 7 and separated from that chamber 7 by a flexible pump wall 11. Distinct from the Example 1 embodiment is that here, in this embodiment, the means to maintain and recover the pump chamber 12 volume is not a resilient property and/or construct of the flexible pump wall 11 but an enclosed compressible structure 16 found within the pump chamber 12. The compressible structure 16 can be as simple as a piece of flexible rubber laboratory hose, a more complex polymeric spring construct, or a highly engineered piece of open cell foam. The structure 16 is defined by its purpose which is the capacity to squeezed by external pressure to sufficiently reduce the fluidic volume of the pump chamber 12 and to repeatedly exercise sufficient structural force to rapidly regain the original fluidic volume when the external pressure is removed. In regaining that original fluidic volume a new dose of fluid product is drawn from the reservoir chamber 7 to replace the earlier dispersed product.

Figure 5:
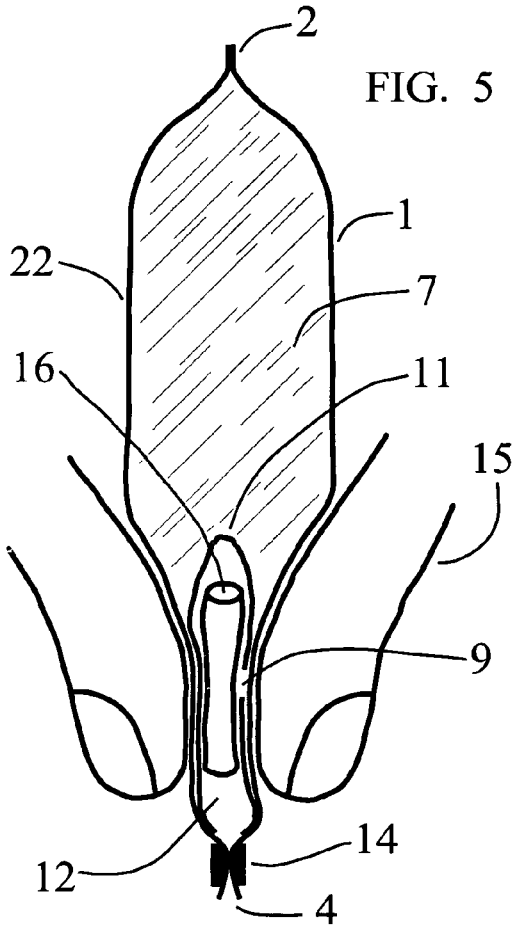
FIG. 5 is a side view of the previous figure showing fingers applying pressure to the pump through the reservoir walls and compressing the pump chamber to dispense the fluid therein.

In FIG. 5 the application of external pressure is illustrated by fingers 15 squeezing the filled pump chamber 12 of FIG. 4 and reducing the volume of the pump chamber 12 significantly. As in the first embodiment of Example 1 the aperture 9 is blocked by a portion of the reservoir chamber wall 22 permitting fluid pressure to build in the pump chamber 12 to sufficient point when it opens the dispersing valve 14 and fluid product exits the dispenser through the exit orifice 4. The pump chamber is refilled on the manner described in Example 1 when the external pressure is removed.

Example 3

Figure 6:
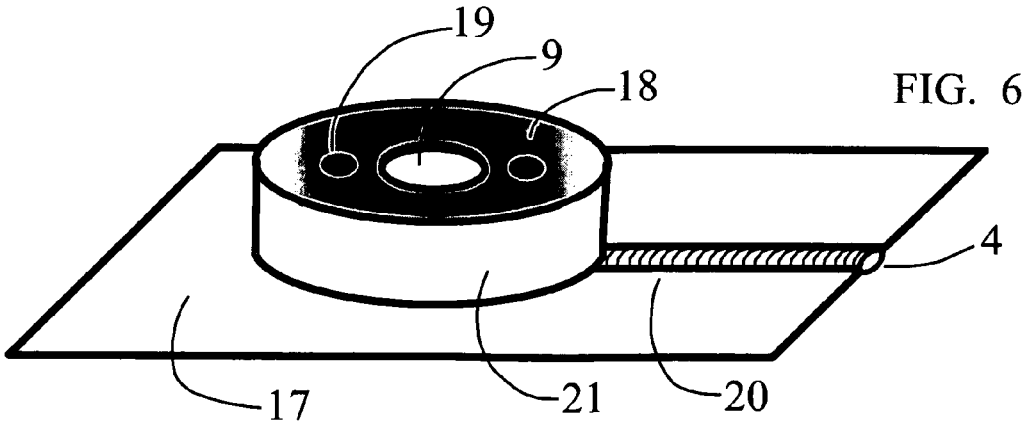
FIG. 6 is a perspective view illustrating elements of an internal button pump before being sealed within and attached to a surrounding fluid reservoir.

FIG. 6 illustrates a form of button pump 18 constructed apart for later inclusion in a reservoir chamber of a fluid dispenser. Shown is a polymeric film base 17 upon which a cylinder or dome 18 of resilient polymer is constructed and sealed to the base 17. An exit channel 20 is formed in the base 17 with a first end opening within the pump chamber formed inside the dome 18 and a second end opening as an exit orifice 4. The dome 18 has an aperture 9 and resilient walls 21 so, when enclosed in a reservoir of liquid product, can behave as a pump in the manner described in Example 1 and Example 2. To position and stabilize the button pump 18 within the reservoir chamber 7 the base 17 edges can be either incorporated in one or more border seal 2 areas or simply attached to a stiff back wall 8. A cuing means, represented here by one or more bumps 19, have been incorporated in the pump surface near the aperture 9 to provide tactile and/or visual guidance to the proper location to which external pressure is applied. The bumps 19 can be felt and/or be seen through the reservoir wall 22 enclosing the button pump 18.

It is to be understood that even though numerous characteristics and advantages of the present invention have been set forth in the foregoing description, together with details of the structure, function, and employment of the invention, the disclosures are illustrative only, and changes may be made in details, especially in matters of shape, size, and arrangement of some parts together with content and materials utilized, within the principles of the invention to the full extent indicated by the broad general meaning of the terms are expressed.

Further, throughout this specification various patents are referenced. The disclosures of these references in their entireties are hereby incorporated by reference in order to more fully describe the state of the art to which the invention pertains. What has been illustrated and described herein are improvement in certain types of squeezable articles of manufacture, specifically of fluid dispensers with internal pumps, with the intent to distribute these articles and dispense hand sanitizing fluid from them for hand rubbing and thereby improving hand hygiene in a population with the intent of significantly reducing the frequency of pathogenic transmission and subsequently reduce sickness and infectious disease within that population. Key to any such successful outcome is the timely availability of the dispenser as needed. By hanging the dispenser embodied in Example 1 from the necks of healthcare workers such as nurses and doctors for their ready access a dramatic and substantial reduction in nosocomial infections can be expected in a hospital or clinic population.

While these improvements have been illustrated and described with reference to certain preferred embodiments, the present invention is not limited thereto. In particular, the foregoing specification and embodiments are intended to be illustrative and are not to be taken as limiting. Thus, alternatives, such as structural or mechanical or functional equivalents, and other modifications will become apparent to those skilled in the art upon reading the foregoing description.

What is claimed is:

1. A fluid dispenser, comprising:

a reservoir chamber and a pump chamber, both chambers having at least one flexible wall surface and containing a fluid in interchamber fluidic communication;

a common wall between said chambers containing an aperture permitting interchamber fluidic communication and capable of being blocked to prevent said interchamber fluidic communications;

a dispensing channel controlling fluid communication between said pump chamber and an exterior orifice for discharge of pressurized pump fluid;

said pump chamber being sufficiently flexible to be reduced in volume by application of external finger pressure sufficient to expel pressurized pump fluid through said orifice and said pump chamber having sufficient resilient means to regain original volume absent said external pressure and refill said original volume with reservoir fluid drawn through unblocked said aperture; and, the pump action transferring said pump fluid characterized by said aperture being blocked and closed by a portion of exterior reservoir chamber wall surface applied directly to said aperture by sufficient purposeful said external finger pressure and opened absence said external finger pressure holding said reservoir wall in a blocking relationship with said aperture and permitting fluidic communication between chambers.

2. The dispenser of claim 1 wherein said aperture is a hole.

3. The dispenser of claim 1 wherein said fluid is a hand sanitizing fluid.

4. The dispenser of claim 1 wherein said dispensing channel incorporates a valve permitting only exiting fluidic passage.

5. The dispenser of claim 4 wherein said valve is a duckbill, check, compression, elastic, flap, reed, slit, spring or similar one-way valve.

6. The dispensing means of claim 1 wherein said external finger pressure is applied by the thumb, palm and/or fingers of a hand.

7. The dispenser of claim 1 wherein said resilient means is provided by an interior resilient material and/or structure enclosed by said pump chamber.

8. The dispenser of claim 1 wherein said resilient means is provided by a property and/or structure of the pump chamber walls.

9. The dispenser of claim 1 wherein said dispenser is a flexible pouch and said pump chamber is fully or partially enclosed by said reservoir chamber.

10. The dispenser of claim 1 further comprising a cuing means associated with said pump chamber aiding in the application of external pressure at the appropriate location to pressurize pump fluid.

11. The dispenser of claim 10 wherein said pump chamber wall has one or more modified surface and/or structural areas functioning as cuing means and detectable by a tactile and/or visual sense.

12. The dispenser of claim 1 further comprising a cuing means associated with said reservoir walls to aid in the application of external pressure at the appropriate location to pressurize pump fluid.

13. The dispenser of claim 12 wherein said reservoir walls has one of more modified surface and/or structural areas functioning as cuing means and detectable by a tactical and/or visual sense.

14. The dispenser of claim 1 wherein said dispenser further comprising an attachment means enabling said dispenser to be attached to, hung on, and/or carried by a person or object.

15. The dispenser of claim 14 wherein said attachment means is selected from a group consisting of adhesives, buckles, buttons, clasps, fasteners, holes, lanyards, loops, magnets, pins, rivets, screws, twists, ties, Velcro or combinations thereof.

16. The dispenser of claim 1 with at least one relatively stiff reservoir wall to facilitate handling and/or attachment.

17. The dispenser of claim 1 wherein both pump and reservoir chambers are sealed from atmospheric contamination and/or loss of fluidic quality and/or quantity.

18. The dispenser of claim 1 wherein a measured, repeatable dose of fluid is dispersed by each said pump action cycle.

19. A fluid dispenser, comprising:

a reservoir chamber and a pump chamber, both chambers having at least one flexible wall surface and containing a fluid;

a common wall between said chambers incorporating an aperture providing fluidic passage between said chambers;

a portion of external reservoir chamber wall placed by finger pressure to said aperture sufficient to block said fluidic passage thru said aperture and sufficient said finger pressure to pressurize pump chamber fluid blocked from said fluidic passage thru said aperture;

a dispensing channel providing exiting fluidic communication between said pump chamber and an orifice for discharging said pressurized pump chamber fluid; and, whereby said pump chamber develops sufficient fluidic pressure from said finger pressure to discharge said pressurized pump chamber fluid from said orifice.

20. A method of fluid dispensing, comprising steps of:

providing a reservoir chamber and a pump chamber, both chambers having at least one flexible wall surface and containing a fluid;

providing a common wall between said chambers incorporating an aperture providing fluidic passage between said chambers;

providing a portion of external reservoir chamber wall placed by finger pressure on said aperture sufficient to block said fluidic passage thru said aperture and sufficient said finger pressure to pressurize pump chamber fluid blocked from said fluidic passage thru said aperture;

providing a dispensing channel for exiting fluidic communication between said pump chamber and an orifice for discharging said pressurized pump chamber fluid; and, applying sufficient said finger pressure to block said fluidic transfer and developing sufficient fluidic pressure in said pump chamber to discharge said pressurized pump chamber fluid from said orifice.

* * * * *